US006470942B1

(12) United States Patent
Susnjara

(10) Patent No.: US 6,470,942 B1
(45) Date of Patent: Oct. 29, 2002

(54) PNEUMATIC CLAMPING APPARATUS AND METHOD THEREOF

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 173 days.

(21) Appl. No.: 09/686,912

(22) Filed: Oct. 12, 2000

(51) Int. Cl.[7] ..... B30B 5/02

(52) U.S. Cl. ..... 156/381; 156/583.3; 100/211; 269/21; 269/22

(58) Field of Search ..... 156/285, 381, 156/382, 583.3; 269/21, 22; 248/683; 100/211; 24/455, 462; D8/72

(56) References Cited

U.S. PATENT DOCUMENTS 5,098,513 A * 3/1992 Budd ..... 156/304.6
5,139,604 A * 8/1992 Mitchell ..... 100/211
5,538,589 A * 7/1996 Jensen et al. ..... 100/211

* cited by examiner

*Primary Examiner*—Michael W. Ball
*Assistant Examiner*—John T. Haran
(74) *Attorney, Agent, or Firm*—Stevens, Davis, Miller & Mosher, LLP

(57) ABSTRACT

The present invention is designed to effectively band ornamental trims onto panel edges, such as those of furniture tops. The present invention utilizes pneumatic forces to hold the ornamental trims against the panel edges instead of traditional clamps, resulting in asserting a uniform pressure press-fitting the trims against the panel edges along a good length of the trims instead of merely along several points of the trims. furthermore, since the contacting surface of the present invention is made of a soft material, it would not leave any pressmarks or indentations on the trims as can left by a hardened clamp.

21 Claims, 3 Drawing Sheets

PNEUMATIC CLAMPING APPARATUS AND METHOD THEREOF

FIELD OF THE INVENTION

The present invention is an apparatus and method for temporarily clamping banding material to the face of a panel edge for the purpose of holding said banding material in place for gluing, pinning or otherwise fastening to the surface of said panel edge.

BACKGROUND OF THE INVENTION

The application of banding materials to panel edges has become commonplace in the furniture industry. Typical uses for such banding applications would be for the perimeter banding of the tops of tables and desks. One of the primary advantages of applying such a banding is that it allows stable yet inexpensive core materials to emulate the appearance of more expensive and desirable hardwood, while keeping the cost relatively low and ultimately providing a more dimensionally stable product.

Veneer and other thin materials are often used for banding the edges of furniture panels. When a shaped, solid edge is desired, it is necessary to apply a more substantial solid material to the edge, which can then be shaped and blended into the veneered top surface.

The processes used for fastening various banding materials include a variety of methods. Veneer and other thin, flexible banding materials are often attached as they are unrolled, by applying heat and pressure to the outer surface. The heat conducts through the surface and melts fast-drying, heat-activated glue on the backside of the material as pressure is simultaneously applied to the surface. Such a process allows for a virtual instantaneous bond, thus negating the need for any post-application pressure.

However, when solid banding material is applied to an edge, heat activation and the resultant instantaneous bonding are not possible. Solid banding material is rigid and typically must be carefully positioned in order to ensure that corner miter joints are lined up. Prior art generally addresses this problem through the application of clamps after the banding is properly positioned. The application of conventional clamps to such an assembly requires careful positioning of the banding material and equally meticulous fitting of the corner miter joints prior to clamping. The physical design of conventional mechanical clamps requires that the banding on the opposite edge be clamped utilizing the same clamp, thus further complicating the alignment task.

Prior art has further addressed the problem by providing mechanical corner clamps that attach the clamp body to the assembly with one or more additional clamping members, thus allowing each clamp to operate independently in each corner of the assembly. This provides a partial solution to the problem but falls short of the objective because it requires the simultaneous activation of multiple clamping members, while holding the banding material in position. The present invention provides a fast-activating pneumatic clamping device that can clamp individual corners, and can do so with the use of one hand, allowing the use of the other hand for positioning the material, thus resulting in a considerable savings in time.

SUMMARY OF THE INVENTION

The first object is to provide a clamping means for attaching banding material to the edge of a panel.

A further objective is to provide a clamping means utilizing a minimal number of manual operations.

Still a further object is to provide a clamping means that requires the use of only one hand by the operator of said clamp.

A further object yet is to provide a clamping means that allows material to be repositioned after said clamping means is fastened to a panel.

DETAIL DESCRIPTION OF THE INVENTION

Figure 1:
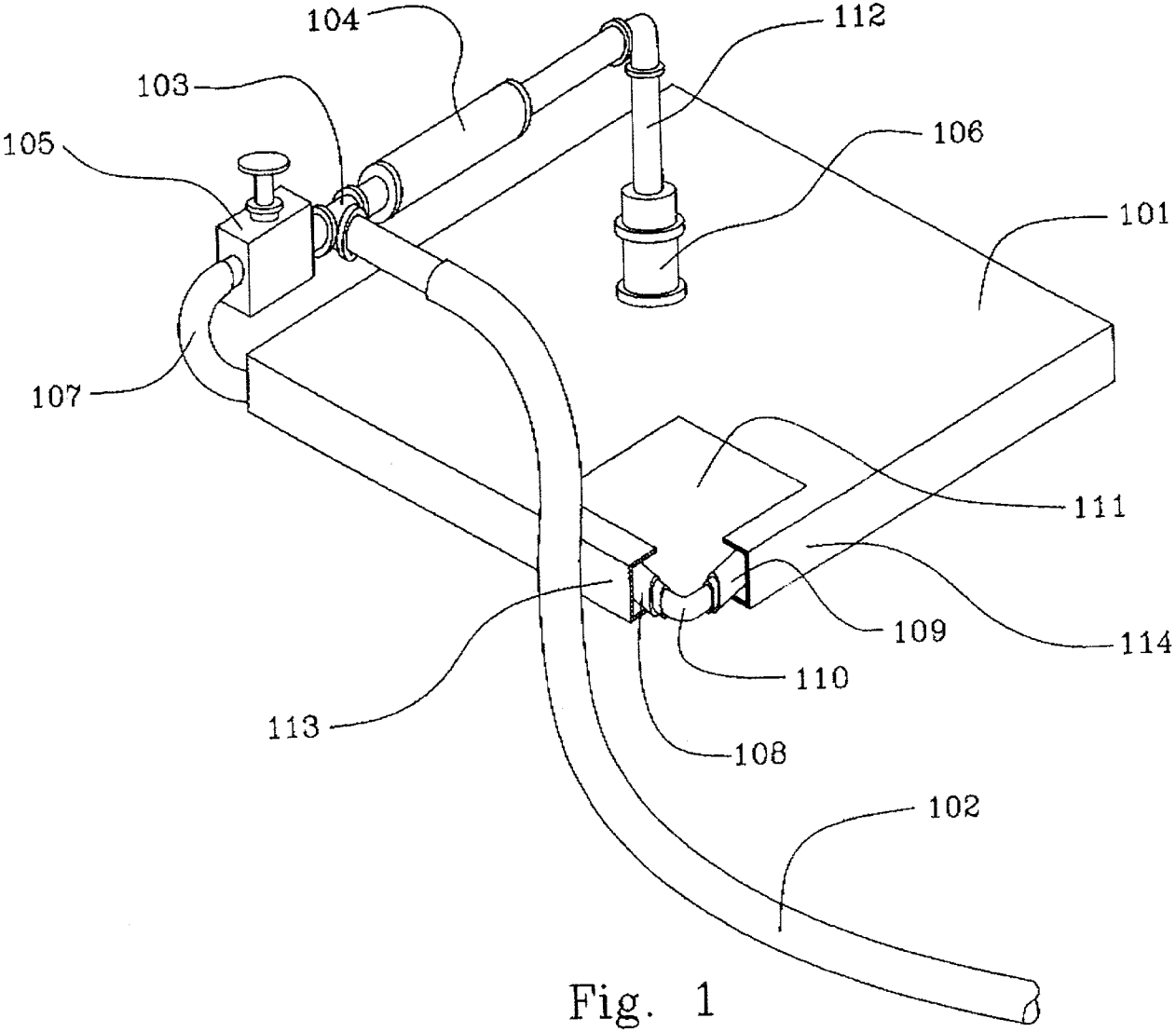
FIG. 1 illustrates a perspective view of an embodiment of a vacuum /pneumatic corner clamping mechanism.

Referring to FIG. 1, a typical embodiment of the present invention comprises a main body 101 with a manually controllable, coaxial, slide actuated valve 106 attached thereto. Attached to said valve by means of ridged piping is a static vacuum generator 104. Such a device utilizes compressed air to create vacuum by means of the venturi principle. An example of such a device well known in the art, is a Gast model VG-015-00-00. Attached to said vacuum generator by means of a rigid "t" fitting 103 is a second manually controllable valve 105 and a tube, 102 for supplying compressed air from an external source. Two adjacent edges of said embodiment 113 and 114, are formed to project downward, and serve as both locating fences, and housings for expandable bladders, 108 and 109. Said bladders are connected in series by a rigid 90-degree pipe fitting 110, to the aforementioned air supply by means of a second manually controllable valve, 105. An opening to allow access through the embodiment 111 has been cut through the surface of said embodiment, bisecting the corner where the aforementioned formed edges 113 and 114 adjoin.

Figure 2:
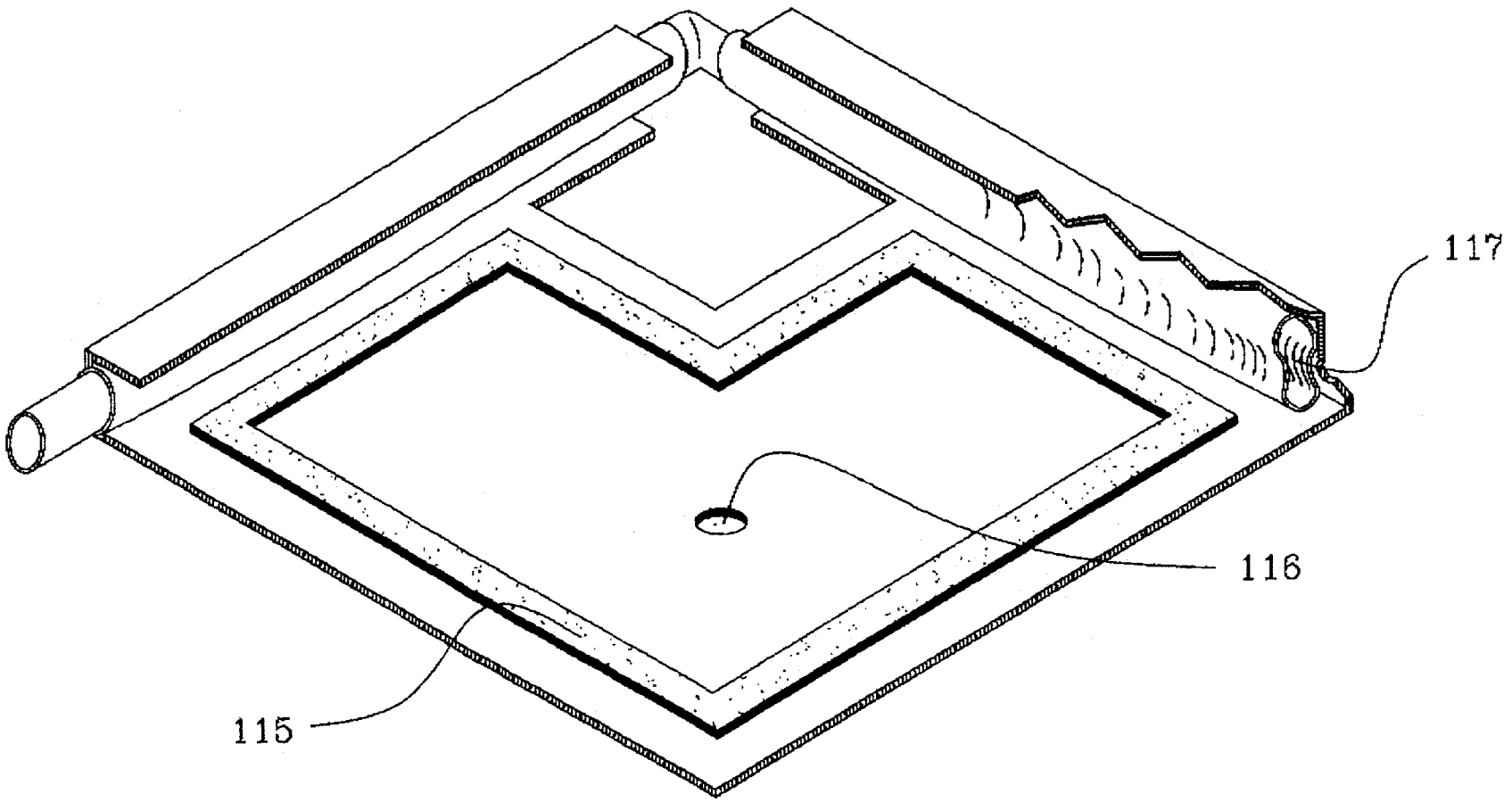
FIG. 2 illustrates a perspective, inverted view of the same clamping mechanism referenced fin FIG. 1, partially sectioned to illustrate the inner components of said clamping mechanism.

FIG. 2 illustrates an inverted view, showing the bottom side of the aforementioned embodiment. A compliant gasket 115 is disposed on the bottom surface, surrounding a port 116 which is directly connected to sliding valve 106. A portion of a channeled edge has been cut away to reveal one of the expandable bladders 117 in a collapsed state.

Figure 3:
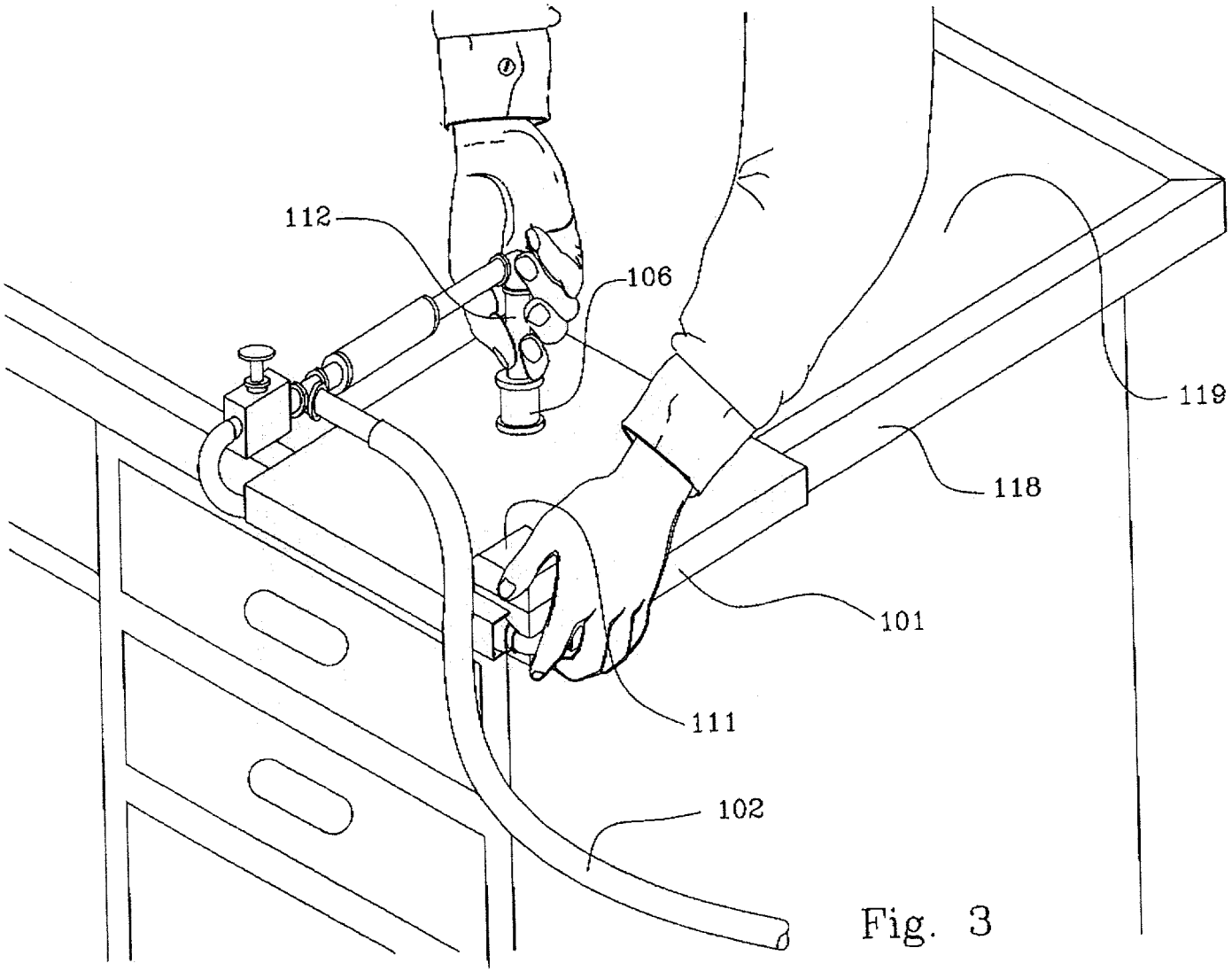
FIG. 3 illustrates a perspective view of the clamping mechanism referenced in FIG. 1 in operational mode.

The mitered, intersecting corners of strips of material used to band the edges of a panel, are difficult to align and are equally difficult to hold in alignment during an assembly operation. The present invention, hereinafter referred to as the clamp, utilizes both vacuum and compressed air to achieve the objective of holding banding material against the edge of a panel, while allowing access through the opening 111, for the purpose of aligning said banding material during the assembly process. The banding material 18 is attached the edge of the panel 119 by means of any one of a diverse variety of methods. A typical installation utilizes a tongue and groove joint, a method well known in the art. The clamp is first connected to an air supply by means of a tube 102. After the attachment of the material to the panel edge, the clamp is placed upon the surface as is illustrated in FIG. 3. The operator, holding the clamp with one hand by means of the rigid pipe fitting 112 utilizes the access opening 111 to make final adjustments to the banding material with the second hand, ensuring that the miter joints are properly aligned. After proper alignment of the material is ensured, the operator slides the clamp in toward the corner, still holding the material in alignment if necessary. When the channeled edges of the clamp make contact with the material, the operator's hand is slid down the pipe fitting 112 to activate the coaxial valve, 106, thus venting the sealed, gasketed area on the bottom side of the clamp to vacuum generated by the vacuum generator, 104. Because the compliant gasket 114 is pressed against the surface of the panel, forming a seal, suction is formed between the bottom of the clamp and the panel surface, thus holding the clamp tightly against the surface of the panel. With the clamp secured in place, the operator's hand is then removed and used to activate the manual valve 105. Upon activation of the manual valve 105, compressed air enters the collapsible bladders 109 and 110, expanding them. Because the clamp is held tightly to the panel surface by suction, The force of the expanded bladders against the banding material provides sufficient pressure to hold the material in place for final fastening without further intervention from the operator. Final fastening may include, but not necessarily be limited to, pinning the material in place with brads through the access opening and/or applying conventional clamps for holding the material until the adhesive has set sufficiently The clamp may then be removed for utilization in another location on the panel, or for utilization on a different panel.

From the foregoing detailed description, it will be evident that there are a number on changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A clamping apparatus, comprising:

a main body having a port and a plurality of adjacent edges each with a channel;

a vacuum generator pneumatically connected to the port;

a valve connected to a plurality of collapsible bladders each residing in the channel;

a first conduit pneumatically interconnected to a compressor, the vacuum generator and the valve;

wherein the vacuum generator generates a vacuuming force when the compressor generates a pumping force.

2. The clamping apparatus of claim 1, wherein the plurality of collapsible bladders receives the pumping force when the valve is opened to receive the pumping force.

3. The clamping apparatus of claim 1, wherein the plurality of collapsible bladders are interconnected by a pipe-fitting.

4. The clamping apparatus of claim 3, wherein the pipe-fitting is a right angle pipe fitting.

5. The clamping apparatus of claim 1, wherein the main body comprises a gasket having a closed loop configuration.

6. The clamping apparatus of claim 5, wherein the port resides within the closed loop configuration.

7. The clamping apparatus of claim 6, wherein when the main body comprising the gasket is placed upon a surface and the vacuum generator generates a vacuuming force, the main body adheres to the surface by the vacuuming force.

8. The clamping apparatus of claim 6, wherein the vacuum generator is pneumatically connected to the port by a second conduit.

9. The clamping apparatus of claim 8, wherein the second conduit comprises one of a pipe and a valve.

10. The clamping apparatus of claim 9, wherein the valve is a sliding valve.

11. The clamping apparatus of claim 1, wherein the main body has a rectangular configuration.

12. The clamping apparatus of claim 1, wherein the first conduit is a T-connector.

13. An apparatus for clamping banding material to a panel edge, comprising:

A solid body having top and bottom plane surfaces; two adjacent, downward projecting locating fences, formed into U-shaped channels, disposed on two adjoining edges of said body;

an access opening, formed through said panel, bisecting the intersecting corner of said locating fences;

a second opening formed through said panel to provide for the passage of air;

a first valve;

a second valve;

a static vacuum generator.

14. An apparatus according to claim 13, wherein said first valve is disposed on the top surface of said panel in engagement with said second opening.

15. An apparatus according to claim 14, wherein a rigid pipe section is disposed in engagement with said first valve.

16. An apparatus according to claim 15, wherein a static vacuum generator is disposed in engagement with said rigid pipe section.

17. An apparatus according to claim 16, wherein a source of compressed air is connected to said vacuum generator.

18. An apparatus according to claim 13, wherein a continuous gasket is disposed around said second opening on the bottom surface of said panel.

19. An apparatus according to claim 13, wherein first and second collapsible bladders are disposed in the channels formed by said locating fence.

20. An apparatus according to claim 19, wherein a pipe-fitting connects said collapsible bladders at the intersecting point of said bladders forming a continuous opening through said collapsible bladders.

21. An apparatus according to claim 19, wherein said first collapsible bladder is connected to a source of compressed air through said second valve.

* * * * *